United States Patent [19]

Yonezawa et al.

[11] Patent Number: 4,929,869

[45] Date of Patent: May 29, 1990

[54] HIGH INTENSITY DISCHARGE LAMP CONTAINING IRON AND SILVER IN THE ARC TUBE FILLING

[75] Inventors: Akihiro Yonezawa, Yokosuka; Hiroki Sasaki, Yokohama; Yoichiro Mitsuyuki, Tokyo; Yasuki Mori, Yokohama; Toshihiko Ishigami, Kawasaki, all of Japan

[73] Assignee: Kabushiki Kaisha Toshiba, Kawasaki, Japan

[21] Appl. No.: 269,367

[22] Filed: Nov. 10, 1988

[30] Foreign Application Priority Data

Nov. 12, 1987 [JP] Japan ..... 62-284209
Sep. 6, 1988 [JP] Japan ..... 63-223006

[51] Int. Cl.[5] ..... H01J 61/20

[52] U.S. Cl. ..... 313/639; 313/642; 313/565

[58] Field of Search ..... 313/638, 639, 642, 565

[56] References Cited

U.S. PATENT DOCUMENTS 3,590,307 6/1971 Dobrusskin ..... 313/642 X
3,781,586 12/1973 Johnson ..... 313/565 X

FOREIGN PATENT DOCUMENTS 141733 5/1980 Fed. Rep. of Germany ..... 313/638
19953 2/1982 Japan ..... 313/642
57-63757 4/1982 Japan .
57-101329 6/1982 Japan .
58-18743 4/1983 Japan .

*Primary Examiner*—Donald J. Yusko
*Assistant Examiner*—Michael Horabik
*Attorney, Agent, or Firm*—Cushman, Darby & Cushman

[57] ABSTRACT

In order to maintain an ultraviolet-ray intensity of a metal halide lamp for a long period, the present invention provides a high intensity discharge lamp comprising an arc tube having electrodes at its both ends, and a rare gas, mercury, iron, a halogen and silver enclosed in the tube, wherein a gram atom ratio of silver to iron is 0.05 to 0.2. The present invention also provides a high intensity discharge lamp comprising an arc tube having electrodes at its both ends, and a rare gas, mecury, iron, a halogen, tin and silver enclosed in the tube, wherein $([Fe]+[Sn])/[J]<0.5$ and $(2[Fe]+2[Sn]+[Ag])/[J]>1$, where [Fe], [Sn], ]Ag] and [J] are, respectively, gram atoms of iron, tin, silver and the halogen.

4 Claims, 1 Drawing Sheet

HIGH INTENSITY DISCHARGE LAMP CONTAINING IRON AND SILVER IN THE ARC TUBE FILLING

BACKGROUND OF THE INVENTION

1. Field of the Invention

The present invention relates to an ultraviolet-ray radiation type high intensity discharge lamp (metal halide lamp) used in curing a printing ink or resist ink utilizing a photochemical reaction.

2. Description of the Related Art

A metal halide lamp in which iron and a halogen together with a starting rare gas and mercury are enclosed in an arc tube having electrodes at its both ends has a good light emission efficiency of ultraviolet rays especially in a UV-A range (315 to 400 nm). Therefore, the metal halide lamp is often used as a light source for a photochemical reaction such as a curing light source for a printing ink, instead of a mercury lamp. However, as an operating time passes, a black deposit is deposited on the inner wall of an arc tube of this lamp to largely reduce ultraviolet-ray intensity.

In order to eliminate the above drawback, Japanese Patent Disclosure (Kokai) No. 57-63757 or 57-101329 discloses a method of suppressing the tube-wall-blackening by adding palladium, zirconium, or titanium in an arc tube.

In a technique disclosed in U.S. Pat. No. 3,590,307, an amount of iron to be enclosed in an arc tube is set to be 0.01 to 1 mg/cc, a halogen (iodine) is enclosed in the arc tube in an amount sufficient to form iron iodide ($FeI_2$) together with iron, and then a halide of tin ($SnI_4$) is added. In this case, ratio $\{[Fe]+[Sn]\}/[J]$ of total gram atoms of iron (Fe) and tin (Sn) to gram atoms of halogen (J) is 0.3 to 0.5.

Japanese Patent Publication No. 58-18743 discloses a metal vapor discharge lamp aiming at improving a spectral distribution. In this lamp, an enclosing amount of a halogen is $1.0\times10^{-8}$ to $1.0\times10^{-5}$ gram atom/cc, a ratio of total gram atoms of iron and tin to gram atoms of the halogen is 0.5 to 3, and a gram atom ratio of tin to iron is 0.05 to 3.

However, even the above lamp does not have a sufficient service life to be used as a curing light source for a printing ink (as will be described later). In addition, since a processing time of a printer is becoming shorter and shorter, the ultraviolet-ray intensity must be sufficiently high in order to sufficiently cure an ink within a short radiation time.

SUMMARY OF THE INVENTION

In order to maintain an ultraviolet-ray intensity of a metal halide lamp for a long period, the present invention provides a high intensity discharge lamp comprising an arc tube having electrodes at its both ends, and a rare gas, mercury, iron, a halogen and silver enclosed in the tube, wherein a gram atom ratio of silver to iron is 0.05 to 0.2.

The present invention also provides a high intensity discharge lamp comprising an arc tube having electrodes at its both ends, and a rare gas, mercury, iron, a halogen, tin and silver enclosed in the tube, wherein $([Fe]+[Sn])/[J]<0.5$ and $(2[Fe]+2[Sn]+[Ag])/[J]>1$, where [Fe], [Sn], [Ag]and [J]are, respectively, gram atoms of iron, tin, silver and the halogen.

DETAILED DESCRIPTION OF THE PREFERRED EMBODIMENTS

Figure 1:
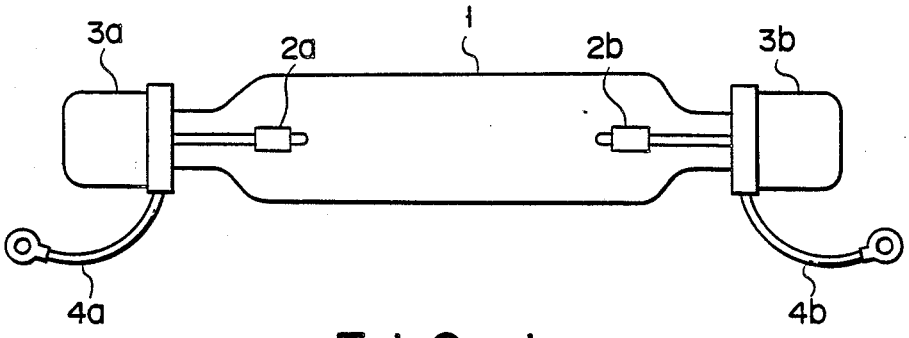
FIG. 1 is a schematic view for explaining a metal halide lamp according to an embodiment of the present invention.

Embodiments of the present invention will be described below with reference to the accompanying drawings.

According to a present inventors' analysis, the black deposit described above was found to be iron and tungsten. That is, it can be assumed that iron enclosed in an arc tube as a light-emitting material and the distal ends of electrodes containing tungsten as a main components melt, spatter and deposit on the tube wall.

Although it is not clear why iron deposits on a tube wall, it can be assumed that an iron halide produced by a reaction between iron and the enclosed halogen (or enclosed as an iron halide from the beginning) is evaporated and dissociated into iron ions and halogen ions in a plasma during discharge, and the free iron ions fly to the inner wall of the tube and are deposited thereon before they are recombined with the halogen ions. Therefore, in order to suppress the tube-wall-blackening, i.e., deposit of iron on the tube inner wall, the number of iron ions near the tube inner wall must be reduced. For this purpose, in the present invention, silver is enclosed beforehand in an arc tube. Enclosed silver reacts with the enclosed halogen before iron reacts with the halogen, thereby forming a silver halide (a silver halide may be enclosed from the start). As represented by the following equation, the silver halide reacts with free iron before free iron is deposited on the tube inner wall, thereby forming an iron halide. As a result, blackening can be prevented. Note that in the following formula, iodine is used as the halogen, and (g) represents a gas state:

$$2AgI(g)+Fe(g)\rightarrow FeI_2(g)+2Ag(g)$$

As a result of the above reaction, silver is made free. However, since silver has a vapor pressure higher than that of iron, silver is not easily deposited on the tube inner wall. Therefore, it is assumed that silver is recombined with the halogen to form the silver halide and the above reaction is repeated to prevent blackening.

If an impurity is mixed in tungsten which is normally used as an electrode material of the metal halide lamp, tungsten is easily melted because its melting point is lowered. That is, if excessive iron or tin is present in an amount exceeding an equivalent amount with respect to a halogen, tungsten as the electrode material forms an alloy having a low melting point together with these metals. It is assumed that this alloy easily melts and spatters to a tube wall during operating time to cause the tube-wall-blackening. Especially when the excessive metal is iron, the above phenomenon tends to occur.

According to the present invention, silver is added in an arc tube having electrodes at its both ends in which mercury, a rare gas, iron, tin and a halogen are enclosed, and the following relations are satisfied assuming that enclosing amounts of iron (Fe), tin (Sn), silver (Ag) and halogen (J) are, respectively, [Fe], [Sn], [Ag]and [J] in units of gram atoms:

$$\{[Fe]+[Sn]\}/[J]<0.5 \quad (1)$$

$$\{2[Fe]+2[Sn]+[Ag]\}/[J]>1 \quad (2)$$

In the present invention, since an amount of halogen is larger than that of iron and tin as indicated in relation (1), there is no case that iron or tin is not fully involved in halogenation and the remainder of iron or tin forms an alloy together with tungsten. Silver need not be taken into consideration because it has nothing to do with spattering of the electrodes (does not form an alloy together with tungsten). In addition, as indicated in relation (2), since an amount of the total metals are larger than their equivalent amount with the halogen in the entire tube, no free halogen is generated. In the present invention, $FeJ_2$, $SnJ_2$ and AgJ are assumed as halides.

If a halogen enclosed in the arc tube is present in an amount larger than its equivalent amount with the metals (halogen rich), a free halogen is generated to prevent electron emission between the electrodes, thereby degrading starting and restarting properties. Therefore, if total gram atoms of the metals are larger than that of the halogen, i.e., if the interior of the tube is in a metal rich state, no free halogen is produced, and the starting and restarting properties are expected to be improved.

That is, in the present invention, the interior of the tube is set in a metal rich state, and silver is used as an excessive metal. Therefore, no free halogen is produced, and the starting and restarting properties are improved. In addition, since free iron is also prevented from being produced, deformation or removal of the electrodes can be prevented, thereby prolonging a service life of lamp.

EXAMPLES 1-3

FIG. 1 is a schematic view showing a metal halide lamp used in these Examples. Quartz glass arc tube 1 having an inner diameter of 20 mm and a length of 110 cm encloses electrodes 2*a* and 2*b* at its both ends. Ceramic mouthpieces 3*a* and 3*b* are mounted on both the ends of tube 1. Connection terminals 4*a* and 4*b*, one end of each of which is connected to a corresponding one of electrodes 2*a* and 2*b*, extend from mouthpieces 3*a* and 3*b*, respectively. The other ends of terminals 4*a* and 4*b* are connected to a power source (not shown).

In these Examples, 15 Torr of argon gas as a starting rare gas, 1.2 mg/cc of mercury, 0.05 mg/cc of iron iodide $FeI_2$ as an iron halide were enclosed in tube 1. Then, 0.004, 0.002 and 0.001 mg/cc of silver iodide as a silver halide were enclosed in such tubes to prepare lamps of Examples 1, 2 and 3, respectively. Therefore, gram atom ratios of silver to iron were about 0.2, 0.1 and 0.05, respectively, in these lamps.

Figure 2:
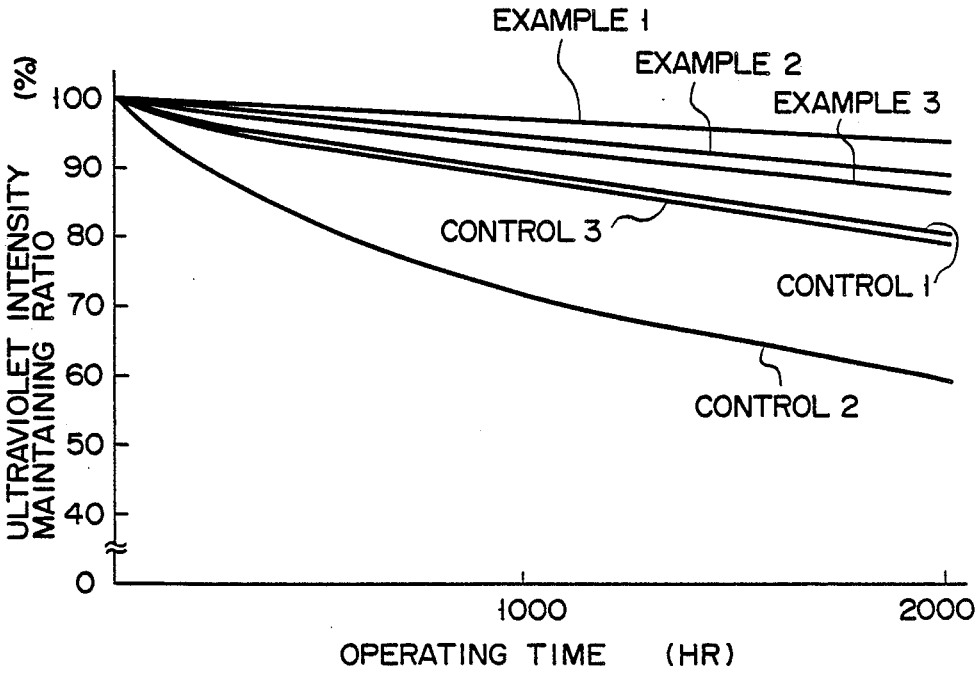
FIG. 2 is a graph showing a comparison of ultraviolet-ray intensity maintaining ratios between a lamp according to an embodiment of the present invention and a conventional lamp.

In addition, using arc tubes having the same structure as those of the above Examples, a lamp (Control 1) in which an amount of silver iodide of the above enclosed materials was set to be 0.0008 mg/cc (i.e., a gram atom ratio of silver to iron was about 0.04), a lamp (Control 2) containing the same species and amounts of enclosed materials as those of Example 1 except for not containing silver iodide, and a lamp (Control 3) in which 0.003 mg/cc of palladium was enclosed in a lamp of Control 1 were prepared. That is, six types of lamps were prepared. Then, 24 lamps of each type were turned on at a lamp wattage of 13.2 kW, thereby performing a comparative test of ultraviolet-ray intensity maintaining ratio. The results (average values of lamps of the respective types) are shown in FIG. 2. As is apparent from FIG. 2, no difference was found between ultraviolet-ray intensities of the lamps of the respective types at an initial stage of operating time. As an operating time passed, however, a difference between the lamps of the present invention and the other lamps became clear. When 2,000 hours passed, a maintaining ratio of the lamps of the present invention was 88 to 95% (the value is normalized assuming that an initial value is 100%), while those of Controls 1, 3 and 2 were reduced to about 82%, 80% and 60%, respectively.

The present inventors also found that when a gram atom ratio of enclosed silver to iron exceeded 0.2, an ultraviolet emission efficiently of an enclosed gas was reduced. This data is shown in Table 1 below.

TABLE 1

| Ag/Fe (gram atom ratio) | 0.3 | 0.2 | 0.1 | 0.05 |
|---|---|---|---|---|
| ultraviolet-ray emission efficiency* | 0.4 | 0.7 | 0.95 | 1 |

*The value is normalized assuming that an initial value is 100%.

EXAMPLE 4 & 5

Materials listed in columns of Examples 4 and 5 of Table 1 were enclosed in arc tubes each having an inner diameter of 20 mm and enclosing tungsten electrodes with an interelectrode distance of 250 mm therebetween. Both of the aforementioned relations (1) and (2) were satisfied. The lamps were turned on at a lamp wattage of 3 kW for 500 hours, and then an ultraviolet-ray intensity maintaining ratio, a restarting time and a degree of electrode melting were observed. The ultraviolet-ray intensity maintaining ratio is normalized assuming that a value obtained immediately after the lamp was turned on is 100%. The degree of electrode melting is represented by "high" when even part of coil-like electrodes were melted, "medium" when projecting shafts of each electrode were melted, and "low" when the electrodes were almost not melted. The lamps of Examples 4 and 5 provided good results in any test. In particular, even when the lamp of Example 5 was kept on for 2,000 hours, its ultraviolet-ray intensity maintaining ratio was 84%, its restarting time was 12 minutes, and its electrodes did not melt. That is, the lamp of Example 5 was proved to have a long service life.

The lamps of Controls 4 to 7 were tested under the same conditions. Since the lamp of Control 4 did not contain silver nor tin, iron was deposited on the arc tube to largely degrade an ultraviolet-ray intensity maintaining ratio. The lamp of Control 5 corresponds to that described in the aforementioned U.S. Pat. No. 3,590,307 and in which an ultraviolet-ray intensity maintaining ratio was improved by adding tin. However, a restarting time (an interval from a timing at which a lamp having a stable lamp wattage is turned off to a timing from which the lamp can be started again by intermediately applying a predetermined input voltage (JIS C7604-1985)) was found to be largely prolonged. The lamp of Control 6 corresponds to that described in the aforementioned Japanese Patent Publication No. 58-18743. This lamp provided good results in the ultraviolet-ray intensity maintaining ratio and restarting time. However, since the distal ends of tungsten electrodes of the lamp were melted to be thin or removed, the lamp service life was found to be short. Note that melting and removal of the electrode distal ends were also found in the lamp of Control 4. In addition, from a comparison between Controls 5 and 6, it was found that even if silver was not contained, the restarting time was largely prolonged when the interior of tube was in a halogen rich state.

The lamp of Control 7 satisfied the relation (2) but did not satisfy the relation (1), and melting of the electrode distal ends was found.

TABLE 2

| Sample No. | Enclosing Amount (gram atom/cc) Fe | Sn | Ag | I | $\frac{Fe + Sn}{I}$ (gram atom ratio) |
|---|---|---|---|---|---|
| Control 4 | $2.46 \times 10^{-7}$ | 0 | 0 | $4.48 \times 10^{-7}$ | 0.55 |
| Control 5 | $2.24 \times 10^{-7}$ | $0.40 \times 10^{-7}$ | 0 | $6.07 \times 10^{-7}$ | 0.44 |
| Control 6 | $2.24 \times 10^{-7}$ | $0.51 \times 10^{-7}$ | 0 | $4.96 \times 10^{-7}$ | 0.55 |
| Control 7 | $2.24 \times 10^{-7}$ | $0.59 \times 10^{-7}$ | $0.46 \times 10^{-7}$ | $5.50 \times 10^{-7}$ | 0.52 |
| Example 4 | $2.24 \times 10^{-7}$ | $0.42 \times 10^{-7}$ | $0.30 \times 10^{-7}$ | $5.50 \times 10^{-7}$ | 0.48 |
| Example 5 | $2.24 \times 10^{-7}$ | $0.42 \times 10^{-7}$ | $1.84 \times 10^{-7}$ | $5.50 \times 10^{-7}$ | 0.48 |

| Sample No. | $\frac{2(Fe + Sn) + Ag}{I}$ (gram atom ratio) | Test Results: Ultraviolet-ray Intensity Maintaining Ratio (%) | Restarting Time (min) | Degree of Electrode Melting |
|---|---|---|---|---|
| Control 4 | — | 62 | 12 | High |
| Control 5 | — | 91 | 90 | Low |
| Control 6 | — | 88 | 11 | High |
| Control 7 | 1.11 | 90 | 13 | Medium |
| Example 4 | 1.02 | 92 | 11 | Low |
| Example 5 | 1.30 | 89 | 10 | Low |

What is claimed is:

1. A high intensity discharge lamp comprising:

a radiation transmitting arc tube;

a pair of electrodes tightly sealed in said arc tube for generating discharge therebetween; and a filling within said arc tube, including rare gas, mercury, iron, a predetermined amount of halogen, and silver, the molar ratio of said silver iron being 0.05 to 0.2.

2. A lamp according to claim 1, wherein said halogen is iodine.

3. A high intensity discharge lamp comprising:

a radiation transmitting arc tube;

a pair of electrodes tightly sealed in said arc tube for generating discharge therebetween; and a filling within said arc tube, including rare gas, mercury, and additives comprising at least a predetermined amount of tin, iron, silver and halogen, said additives substantially satisfying the following relationship;

$$([Fe]+[Sn]/[J]<0.5, \text{ and}$$
$$(2[Fe]+2[Sn]+[Ag]) / [J]>1$$

where [Fe], [Sn], [Ag] and [J] are, respectively, atoms of iron, tin, silver and halogen.

4. A lamp according to claim 3, wherein said halogen is iodine.

* * * * *